US005782360A

United States Patent [19]

Markson

[11] Patent Number: 5,782,360

[45] Date of Patent: Jul. 21, 1998

[54] CUBIC DISPLAY DEVICE

[75] Inventor: Richard Markson, Goshen, N.Y.

[73] Assignee: Markson Rosenthal & Company, Englewood Cliffs, N.J.

[21] Appl. No.: 813,604

[22] Filed: Mar. 7, 1997

[51] Int. Cl.[6] ..... B65D 19/00

[52] U.S. Cl. ..... 206/600; 206/597; 150/154

[58] Field of Search ..... 206/597, 600, 206/736; 150/154; 190/107, 127; 383/104, 119

[56] References Cited

U.S. PATENT DOCUMENTS

| | | | |
|---|---|---|---|
| D. 249,430 | 9/1978 | Chervenak | D6/432 |
| D. 259,402 | 6/1981 | Nattrass | D9/432 |
| D. 293,178 | 12/1987 | Hamami | D6/448 |
| D. 293,746 | 1/1988 | Sayward | D6/448 |
| D. 294,896 | 3/1988 | Weiss | D6/432 |
| 2,016,520 | 10/1935 | Short | 190/107 |
| 3,382,001 | 5/1968 | Schafer et al. | 297/462 |
| 4,244,411 | 1/1981 | Karlström et al. | 150/52 |
| 4,782,873 | 11/1988 | Messner et al. | 150/52 |
| 4,877,137 | 10/1989 | Govang et al. | 206/597 |
| 4,948,154 | 8/1990 | Guggenheim | 280/79.3 |
| 4,954,384 | 9/1990 | Hartwell | 428/100 |
| 5,009,189 | 4/1991 | Neff | 383/119 |
| 5,226,544 | 7/1993 | Gallucci et al. | 206/597 |
| 5,251,753 | 10/1993 | Pigott et al. | 206/386 |
| 5,388,702 | 2/1995 | Jones | 206/597 |
| 5,450,965 | 9/1995 | Cox | 206/597 |
| 5,605,232 | 2/1997 | Bickle | 150/154 |
| 5,620,108 | 4/1997 | Hsu | 206/600 |

*Primary Examiner*—David T. Fidei
*Attorney, Agent, or Firm*—Abelman, Frayne & Schwab

[57] ABSTRACT

A display unit is disclosed for protectively storing and presenting pallet-loaded products, typically soft drink packages, for manual removal therefrom. It includes a generally rectangular frame assembly, which is advantageously shipped to the site in a knockdown condition. The assembly is formed of a plurality of rods, connected by corner elements, and enveloped by a plurality of wall units having a front closure. A plurality of anchor plates are secured to spaced locations of the base frame and are positioned below a pallet-load of products to be dispensed, such that the weight of the products as transmitted to the anchor plates, retains the display unit in place on the ground support without necessitating any additional permanent anchoring means.

14 Claims, 7 Drawing Sheets

CUBIC DISPLAY DEVICE

FIELD OF THE INVENTION

The present application relates to a display unit for protectively storing and presenting pallet-loaded products for manual removal therefrom. More particularly, the display unit is of the type which is intended to remain outdoors, such as in association with a gas station or convenience store, and contain a plurality of individual units of merchandise stored on a pallet, such as packages of soft drinks. Advantageously, the display unit may be compactly shipped to the site in a knockdown condition and readily assembled with minimal difficulty.

BACKGROUND OF THE INVENTION

Retail establishments present the consumer with a variety of competitive products. In addition to package designs to attract the consumer's attention, and hence promote product selection, various displays are utilized for attractively, protectively, and efficiently containing and dispensing the individual products. While a great majority of such displays are intended for use within buildings, such as within supermarkets, pharmacies, or convenience stores, oftentimes the need arises to display such products at an outside location. For example, it is quite common for gas stations to sell cartons of soft drinks (typically known as "six-packs" or "twelve-packs") from an outside location where they may be exposed to adverse environmental conditions. This may tend to deteriorate the package, thereby detracting from its otherwise positive presentation, and hence, reduces the probability of customer selection. Accordingly, it is naturally desirable to protect packages while they are in the outside location, while advantageously providing such protection in a low-cost manner which enhances the product presentation.

Further, the display unit should advantageously be of a type which may be moved to different locations at the on-site establishment, without requiring any permanent installation to the ground surface, while remaining in place when subject to adverse environmental conditions, such as wind or rain.

SUMMARY OF THE INVENTION

The display unit of the present invention is intended to protectively store and present pallet-loaded products, typically cartons of soft drinks, for manual removal therefrom at an outside location. It comprises a generally rectangular housing which may be configured to contain a pallet-load of soft drink packages. The display unit is advantageously of a knockdown type, which can be compactly shipped and then readily assembled at the site location. It includes a frame assembly having a base frame formed of successively interconnected horizontal rods. A plurality of anchor plates are secured to spaced locations of the horizontal rods and extend inwardly into the internal volume defined by the frame assembly so that they will be positioned below the pallet supporting the products being dispensed. Hence, when the loaded pallet is placed within the display unit, the weight of the pallet-supported products, as transmitted to the anchor plates, will retain the display unit in place on the ground support, without the need to provide auxiliary anchoring of the display unit to the ground support. However, in those situations where it is desired to permanently locate the display unit, the anchor plate may include auxiliary securing means such as apertures which receive bolts for attaching the anchor plates to the ground support.

Extending upwardly from each of the four corners of the base frame is a vertical rod, with the upward extent of the vertical rod defining the height of the display unit. A rectangular top frame is formed of top rods, generally corresponding to the rods forming the base frame. The top wall is advantageously supported on the top frame by a plurality of top wall supporting rods which are outwardly arced to convexly support the top wall. Hence, the base frame, vertical rods, and top frame form a generally rectangular enclosure which is configured to contain the pallet-load of products to be dispensed therefrom. The various rods forming this enclosure are connected together at their junctures by corner connections, each of which include three orthogonally-separated connecting elements which are adapted to receive and position the three ends of their respective rods. All the surfaces of the display unit, with the exception of the bottom frame, are covered by wall surfaces to protect the contents to be stored therein. The front wall surface contains releasable closure means, typically Velcro, to readily permit its opening to display the contents of the display unit, and permit manual removal of its individual products. Advantageously, two unitary wall unit assemblies are provided. One such wall unit assembly contains the right, rear, and left walls. The other wall unit assembly contains the top and front walls.

To further enhance the compactness of the display unit, as shipped to the site location, the unitary wall units may each be formed of a flexible material, which may be rolled for packaging in conjunction with the individual rods and corner connections, thereby minimizing the requisite shipping volume of the display unit. Advantageously, the outer surfaces of the walls may include indicia of the product being dispensed, to further enhance its consumer presentation.

Accordingly, it is a primary object of tie present invention to provide an outdoor display unit for protectively storing and presenting pallet-loaded products for manual removal therefrom.

A further object of the present invention is to provide such a display unit which is of a simplified construction, and can be shipped to the site in a knockdown condition.

Another object of the present invention is to provide a display unit, particularly adapted for the outdoor storage and presentation of a pallet-load of soft drink products, and which does not require any permanent anchoring to the ground support for retaining the display unit in its desired location when subjected to adverse environmental conditions.

Yet another object of the present invention is to provide such a display unit which completely encloses the products being dispensed, but may be readily opened to reveal the products to the intended consumer in an aesthetically pleasing and non-interference manner.

These as well as other objects of the present invention will become apparent upon the consideration of the following drawings and description.

DETAILED DESCRIPTION OF DRAWINGS

Figure 4:
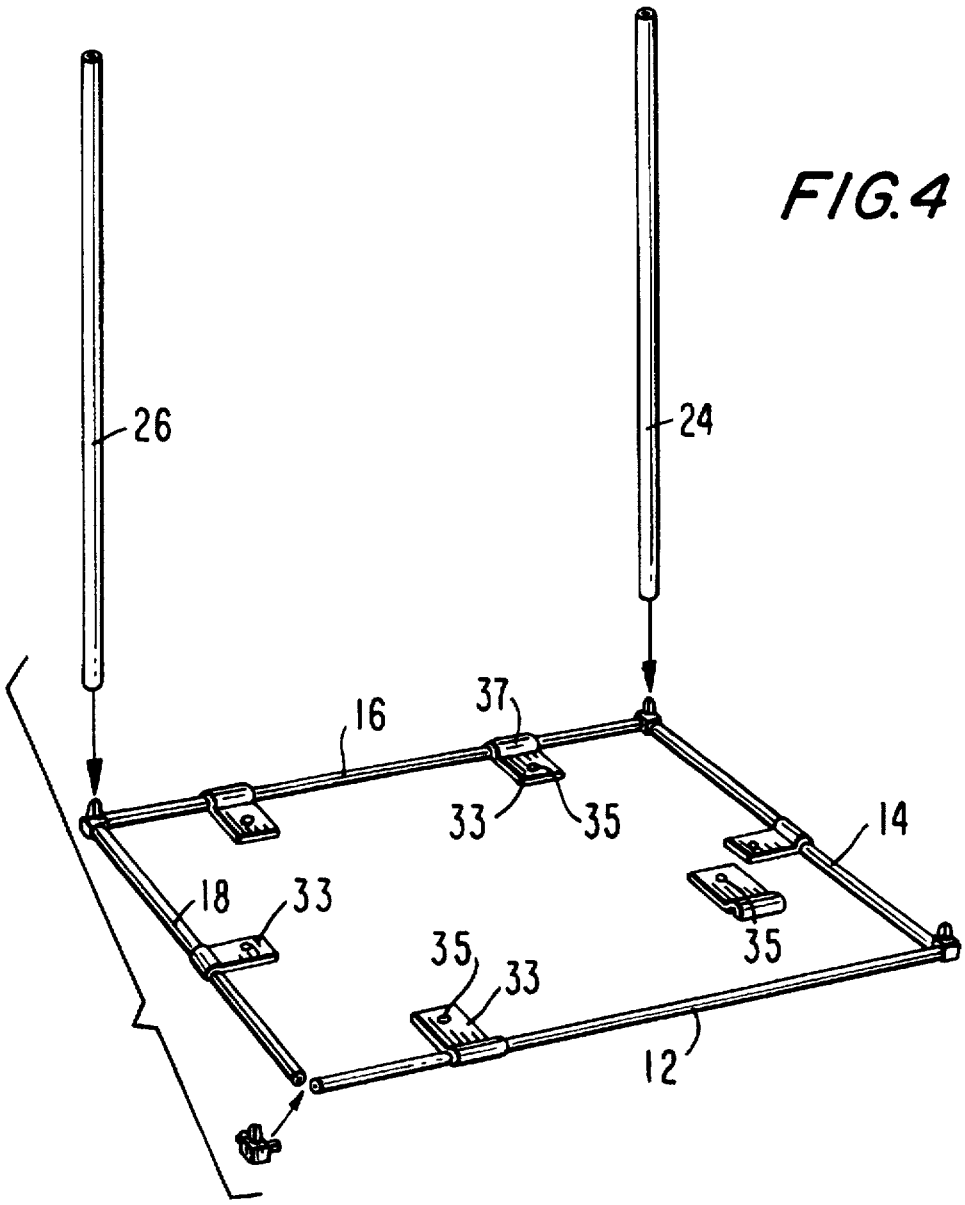
FIG. 4 shows the first step in the site assembly of the display unit, which has been shipped thereto in a knockdown mode.
Figure 4A:
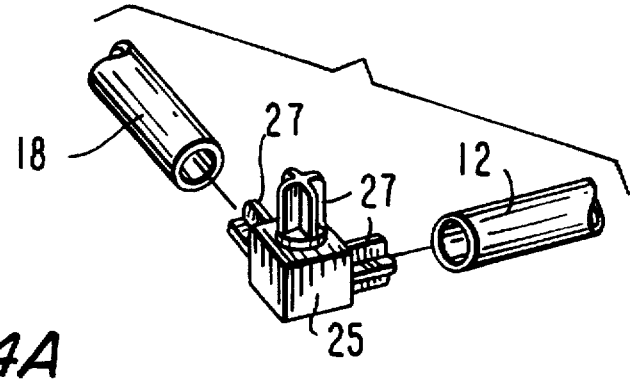

FIG. 4*a* shows a detail of one of the corner connections utilized to assemble the display unit.

Figure 5:
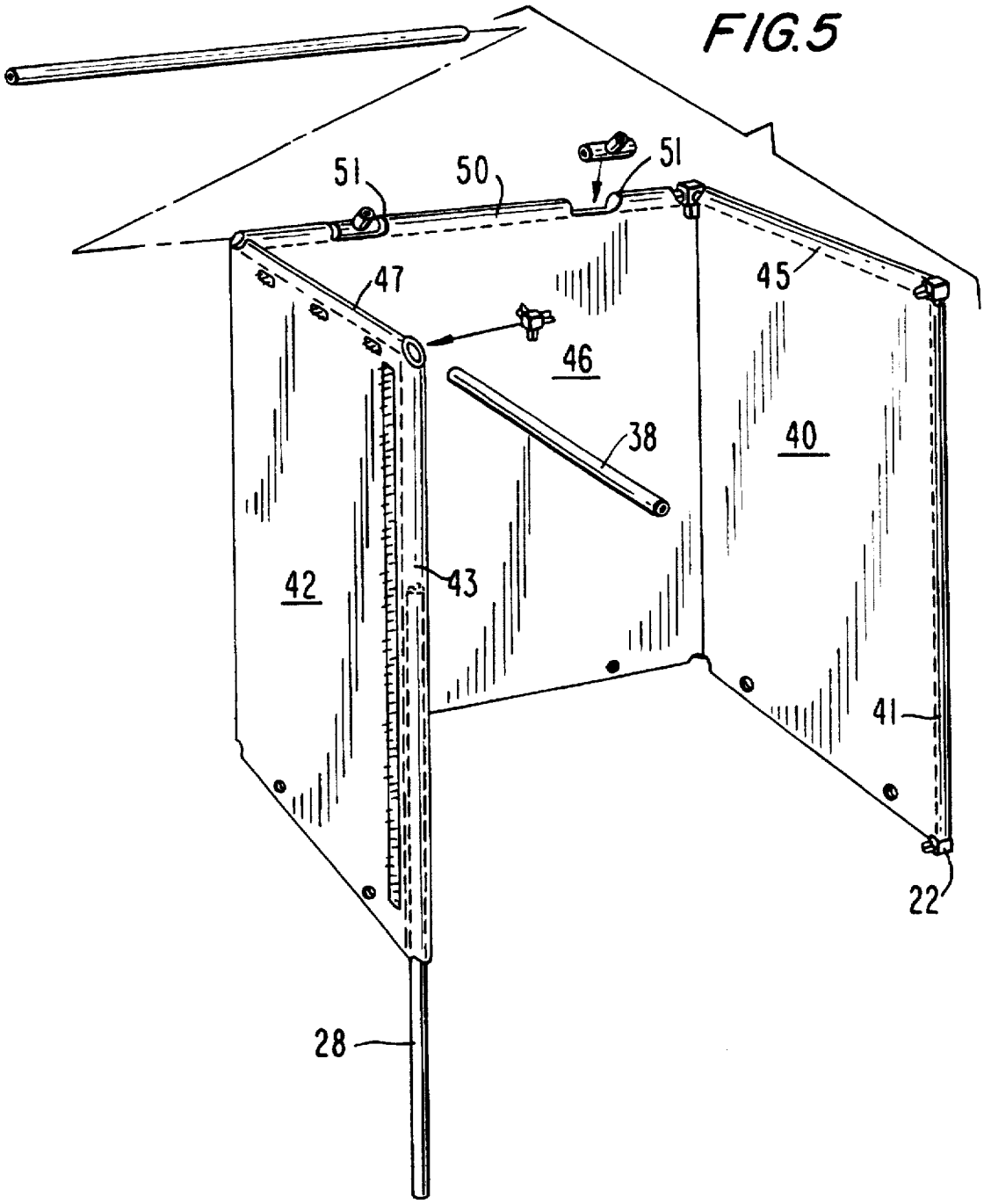

FIG. 5 shows the next step in assembling the display unit.

Figure 5A:
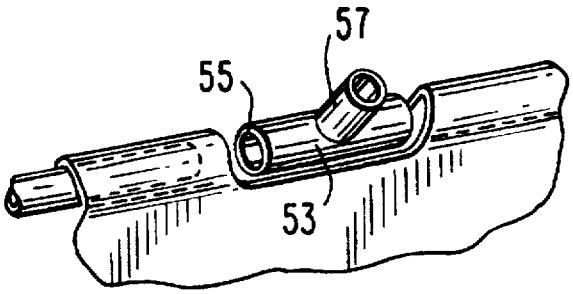

FIG. 5*a* shows a portion of the display unit, including the connecting member for the roof wall supports.

Figure 6:
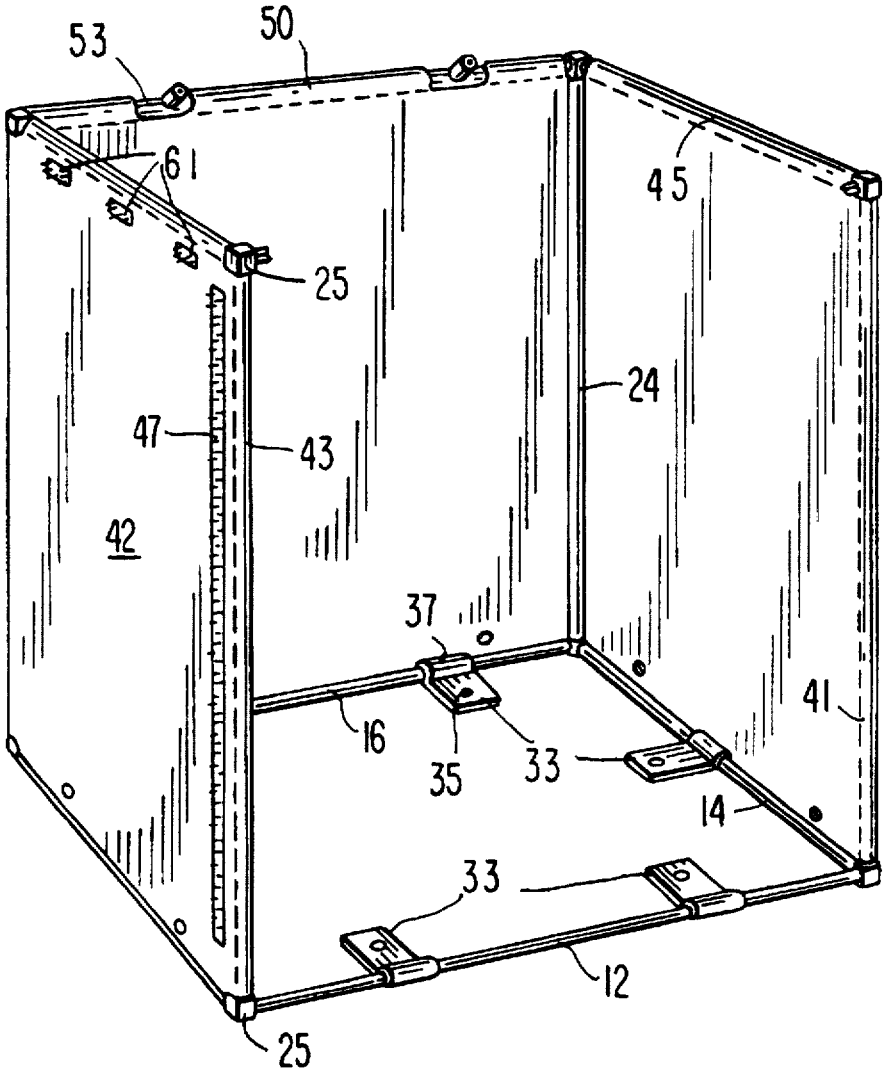
Figure 7A:
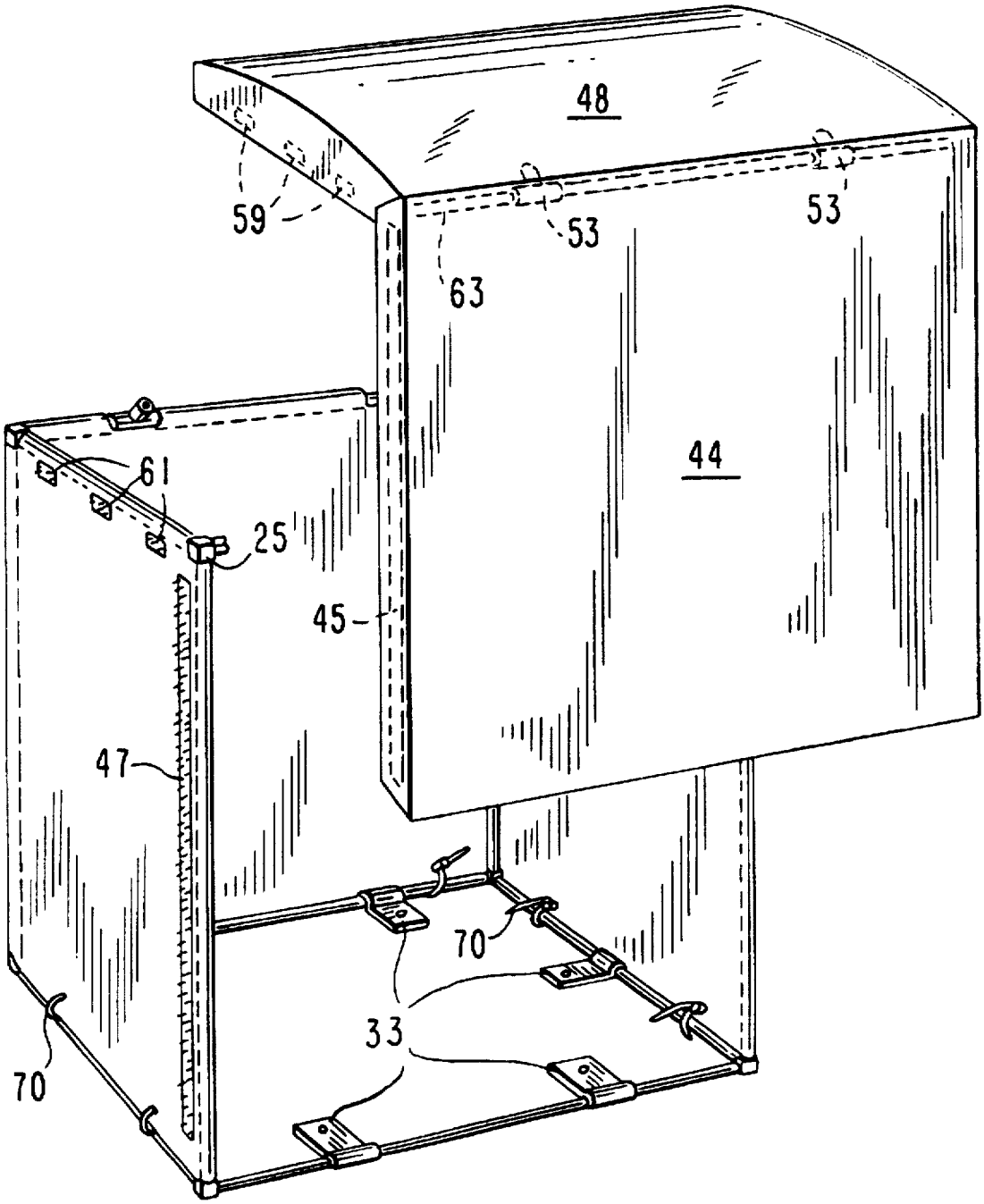
Figure 7A:
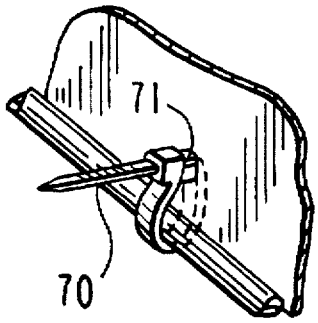
Figure 8:
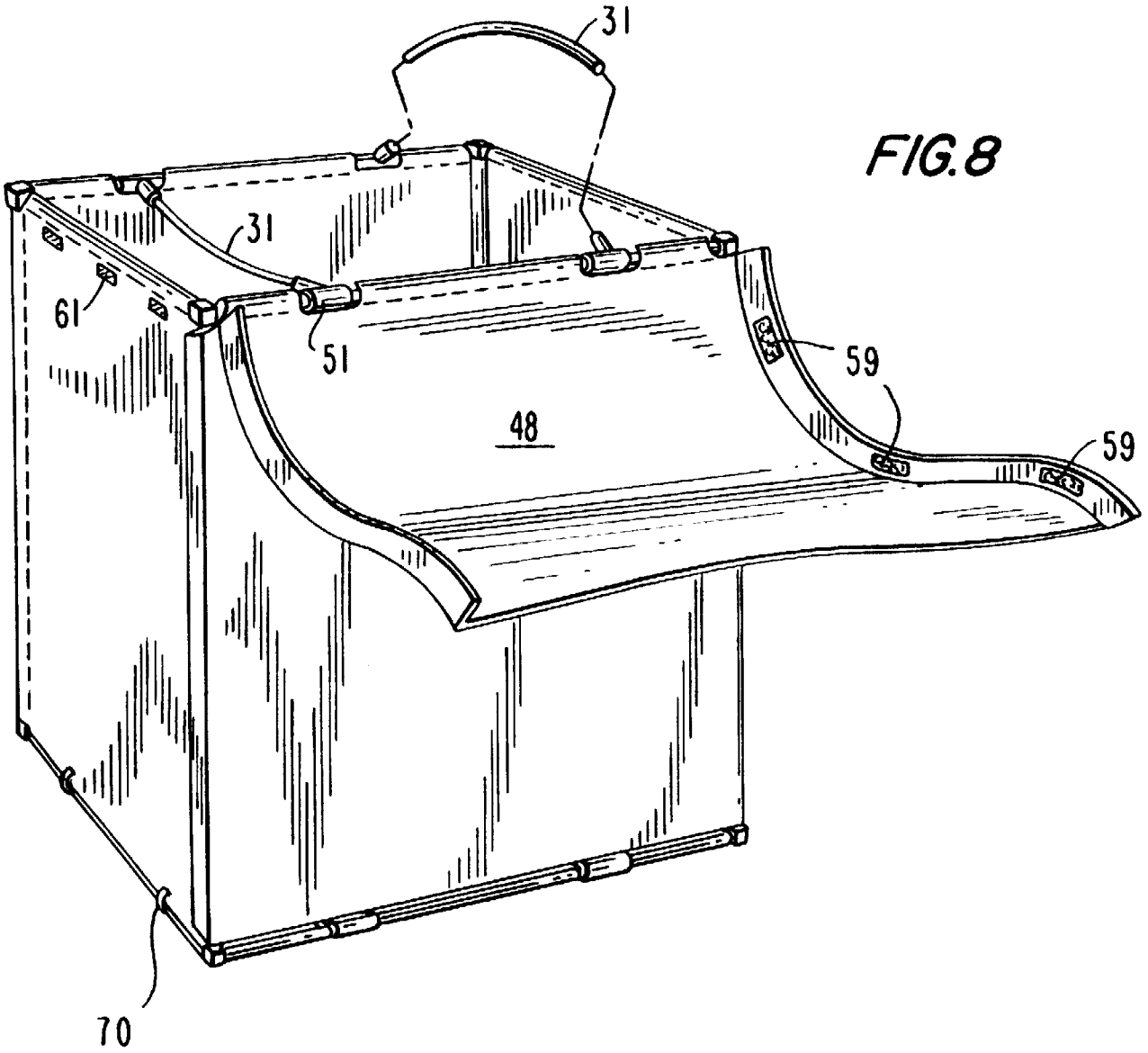

FIGS. 6–8 sequentially show the next steps in the assembly of the display unit, with FIG. 7*a* showing a detail of the strap connections between the side and rear walls and the base frame.

Figure 1:
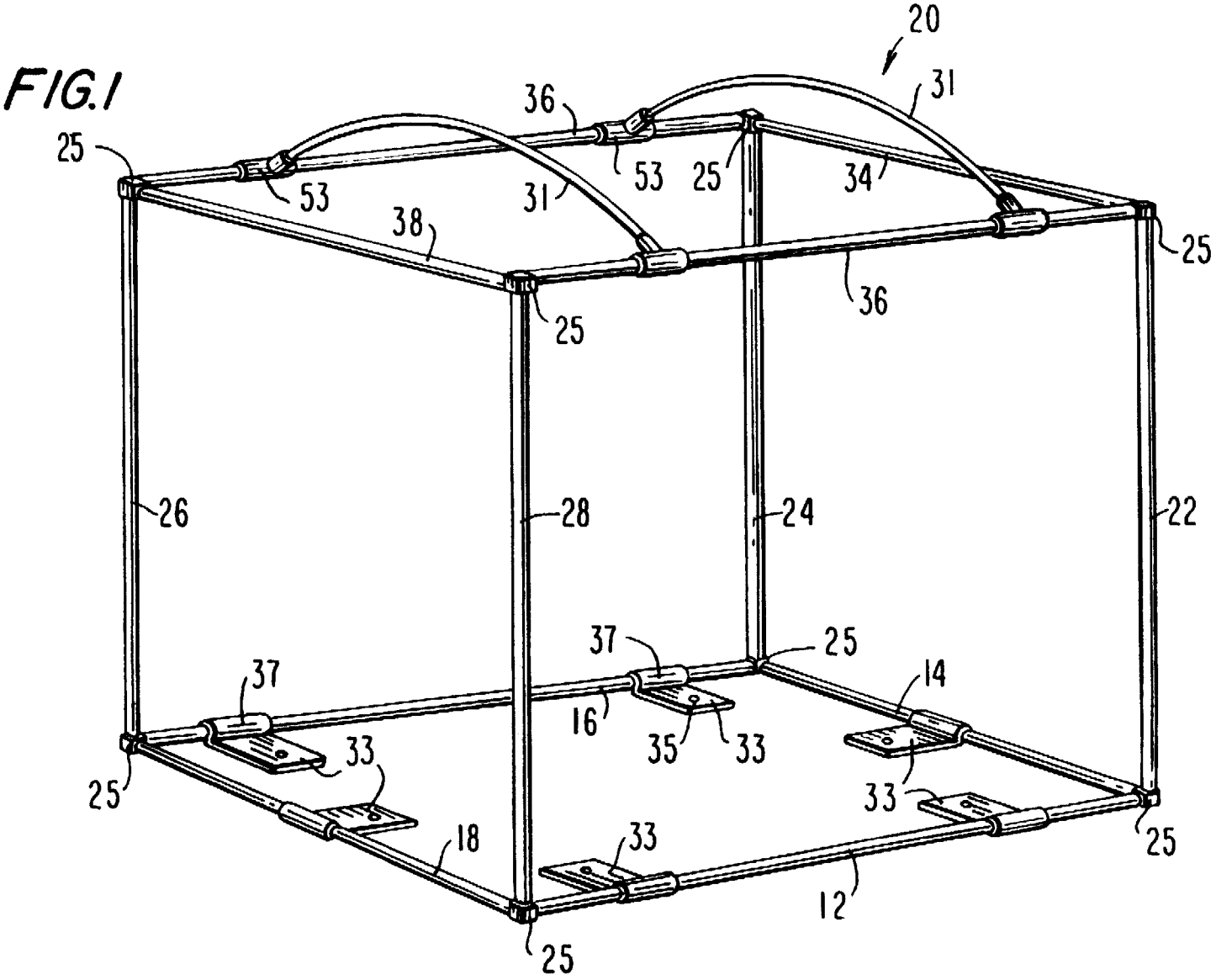
FIG. 1 is a perspective view of the frame assembly forming the display unit.

Referring initially to FIG. 1, the display unit, generally shown as 10 includes a frame assembly formed of a plurality of interconnected rods and connecting members which are preferably shipped to the site in a knockdown condition, so as to minimize their volume, and hence provide for more convenient and cost-effective shipping. The frame assembly includes a generally rectangular base frame formed of successively interconnected horizontal rods 12, 14, 16 and 18. Rods 12 and 16 define the front and rear sides of the base frame, and rods 14 and 18 define the right and left sides, respectively, of the base frame. Four vertically extending rods 22, 24, 26 and 28, extend upwardly from the base frame with the lower end of each vertical rod connected to a corner juncture of two adjacent base rods. At each of the juncture connections, a corner connector 25 (shown in greater detail in FIG. 4*a*) is utilized. The corner connector 25 has orthogonally-separated connecting elements 27 adapted to receive and position the three ends of their respective base rods and associated vertical rod, which meet at the particular juncture. A rectangular top frame, generally corresponding to the base frame, is connected to the vertically upper ends of rods 22, 24, 26 and 28 by similarly configured corner connectors 25, such that the top frame overlies the base frame and is spaced therefrom by the vertical extent of the vertical rods. The top frame 10 is formed of successively interconnected rods 32, 34, 36 and 38, which respectively correspond to rods 12, 14, 16 and 18 of the bottom frame. Top wall supporting rods 31, which are preferably outwardly arced, extend between spaced intermediate locations of opposed top rods 32, 36.

Connected to the bottom frame are a plurality of anchor plates 33. The anchor plates serve, as will be subsequently discussed, to retain the assembled display unit 10 in its desired site location.

Figure 3:
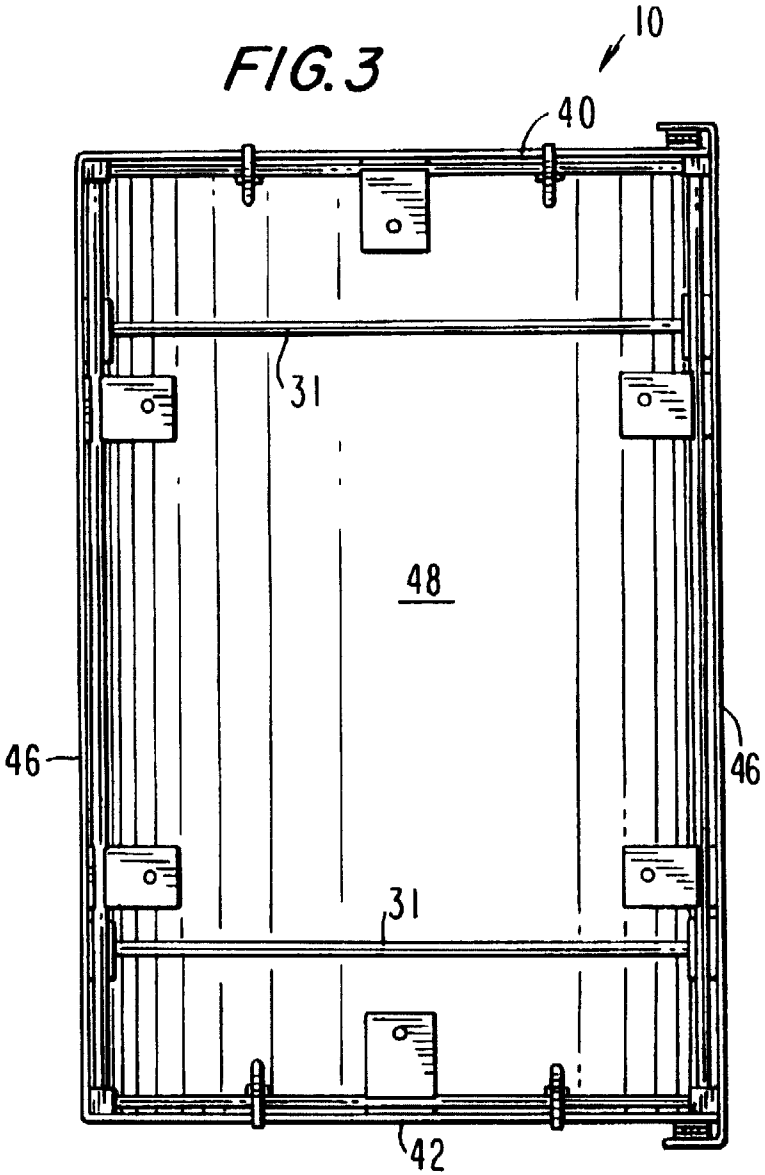
FIG. 3 is a bottom view of the assembled display unit in the closed condition, and without any contents.
Figure 2:
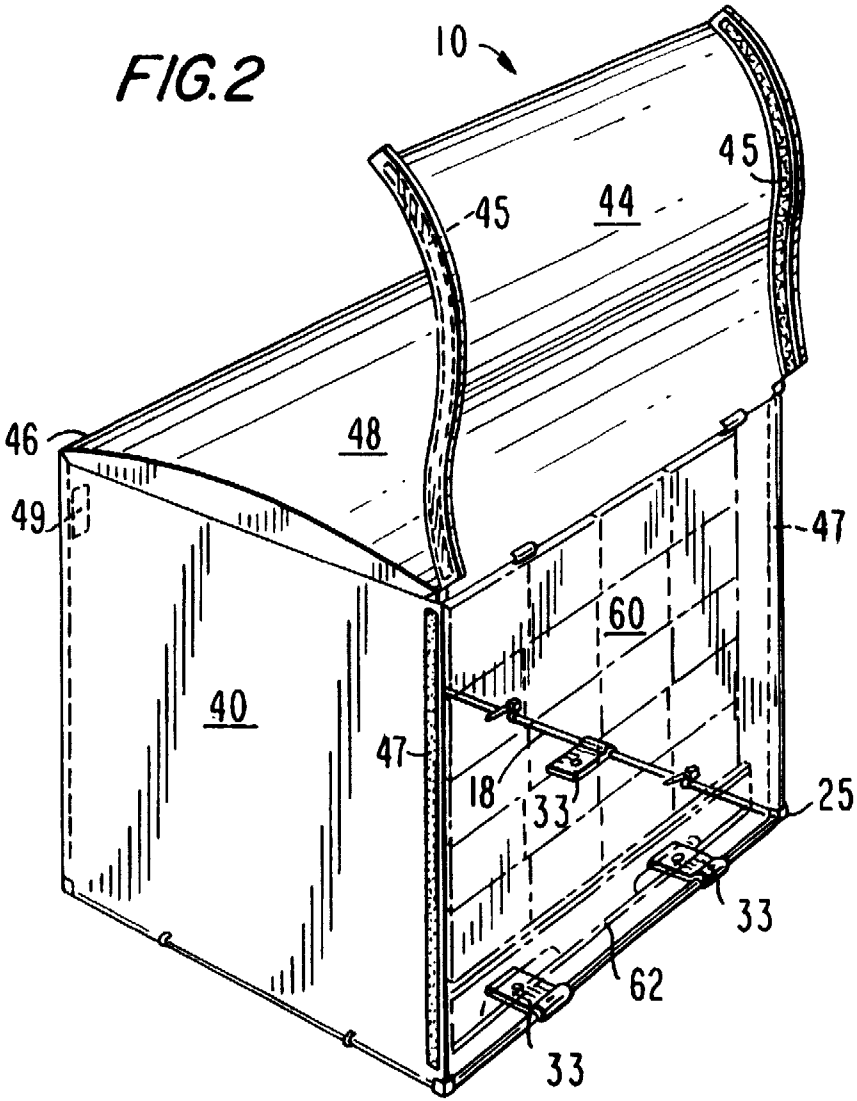
FIG. 2 is a perspective view of the assembled display unit, with a pallet-load of soft drink packaged container therein, and shown in phantom, and the front wall shown in the process of being opened.

Referring to FIGS. 2 and 3, the display unit includes a plurality of walls connected to the frame assembly. They include a right wall 40, left wall 42, front wall 44, rear wall 46 and top wall 48. The front wall 44 includes a releasable closure means 45 along each of its opposed sidewardly turned vertical edges. The releasable closure means may typically be a Velcro strip. A complementary closure means 47 is located along the forward edges of right and left walls 40, 42, so as to permit the front wall 44 to be selectively moved between an open or closed condition. Although Velcro closures 45, 47 are shown, alternative closures well known in the art may be used such as snaps or zippers. Advantageously, a small Velcro strip 49 is provided along at least one of the upper exterior portions of the rear wall 46, so as to retain the front wall 44 in the open condition.

Accordingly, the right, rear, left, front and top walls (40, 42, 44, 46, 48) enclose a generally rectangular volume open at its base. The base is, however, closed by the ground support 11. This volume is adapted to receive a plurality of units of products 60, as shown in phantom in FIG. 2, which are stacked on a pallet-support 62. The display unit 10 may be typically dimensioned to contain a pallet-load of soft drink products, with the individual packages 60 being typical packs of twelve cans, or six bottles. Naturally, other products may be placed within the display unit 10, which would be suitably altered in its shape and dimensions to appropriately accommodate such other products.

In accordance with a particularly advantageous feature of the present invention, the pallet 62 will rest on the inwardly extending ends of anchor plates 33. Accordingly, the weight of the products 60 stored on pallet 62 as transmitted to the anchor plates 33 will appropriately retain the display unit in place on the ground support 11 without requiring any auxiliary anchoring support. However, in those situations where it is intended to permanently locate the display unit, apertures 35 may be provided within the anchor plates 33 for accommodating an appropriate procurement member (not shown) such as a bolt.

Reference is now made to FIG. 4 which shows the first step in the sequential assembly of the display unit from the individual parts shipped to the site. The base frame is first formed of rods 12, 14, 16 and 18, inserted within the corner connectors 25. The rear vertical rods 24, 26 are connected to their respective corner connectors 25. It should be noted that each of the corner connectors 25 include a plurality of orthogonally-related connecting elements 27 appropriately dimensioned to tightly engage the inner bore at the ends of the rods to be connected thereto. Anchor plates 33, each of which include an arcuate end section 37 which frictionally snaps over the exterior of the associated base rod member, is then installed at spaced locations along each of the base rods.

Refer next to FIG. 5, the right, left and rear wall members (40, 42, 46) are preferably formed of a first unitary assembly. This unitary wall assembly is preferably formed of a flexible material, such as vinyl, selected to withstand anticipated adverse environmental conditions. Front vertical rods 22 and 28 will be slid into pockets 41, 43 along the frontal portion of the right and left walls 40, 42. The top rods 34 (not shown in FIG. 5) and 38 are similarly slid into pockets 45 and 46 along the upper extent of the right and left walls 40, 42 respectively. The rear wall 46 includes a pocket 50 having cut out portions 51. Cut out portions 51 are adapted to receive a T-shaped connecting joint 53 (shown in detail in FIG. 5*a*). T-shaped connecting joint 53 includes an internal bore 55 adapted to receive the top rod 36, and extension 57 adapted to enter the internal bore of roof support rod 31. Accordingly, rear rod 36 is inserted into one of the ends of pocket 50, and passes successively through the two T-shaped connectors 51, 53, at cut out portions emerging at the other end of the pocket 50. The assembly shown in FIG. 5 is then slid onto the rear vertical rods 24, 26, forward vertical rods 22, 28 are connected to the forward base corner connectors 25, and upper corner connectors 25 are inserted at the four corners of the top base. This results in the configuration shown in FIG. 6. It is to be noted that internal pockets are not provided for rear vertical rods 24, 26, which are intended to be externally positioned along the internal edge of their respective corners.

Referring now to FIG. 7, the top wall 48 and front wall 44 comprise a second unitary assembly, which will be formed of the same material on the first unitary wall assembly. If desired, the exterior surface of the walls may include indicia representative of the contents, thereby enhancing the overall consumer appeal presented by the display unit. Front wall 44 includes the Velcro closure members 45 about a sidewardly in-turned end, which mate with complementary Velcro closures 47 along the right and left walls. Velcro closure members 59 are provided along downwardly turned portions of the top wall 48, to mate with complementary Velcro closure members 61 positioned along the top edge of the right and left walls. Velcro closure members 59, 61 may alternatively be replaced with other types of releasable closure members, such as snaps or zippers. The bottom regions of each of the right, rear and left walls include two spaced apertures 71 which are adapted to receive a retaining strap 70 (as best shown in FIG. 7*a*) for securing the right, rear and left walls of the first unitary wall assembly to rods of the base frame.

To continue with the assembly, the top rod 32 is inserted within pocket 63 which, similar to pocket 50, includes recesses for T-shaped connecting elements 51. The ends of rod 53 are then inserted within its respective corner connectors 25.

Referring to FIG. 8, two supporting rods 31 are then inserted within portions 57 of their respective connectors 53 while the supporting rods 31 are arcuately flexed downward. They are then flexed upward, as shown in FIG. 3. The top wall 48 is then pivoted about rod 32, and Velcro members 59 secured to complementary Velcro member 61 to retain the top wall in its desired position.

With the unit completely assembled, the front wall 44 may then be lifted up as shown in FIG. 2 (with the free end of the front wall 44 preferably engaging rear wall Velcro member 49 to retain the front wall in its open position) and a pallet-load of products is inserted therein.

While the general arrangement shown by my invention can be suitably modified in size to accommodate different products, the following dimensions have been found to be particularly advantageous for a soft drink package dispensing unit.

Base rods 12, 16, top rods 32, 36, and all the vertical rods 22, 24, 26, 28 may be in the order of 60 inches.

Base rods 14, 18, and top rods 34, 38, may be in the order of 42 inches.

It should be understood that the foregoing description of the invention is intended merely to be illustrative thereof and that other embodiments, modifications, and equivalents may be apparent to those skilled in the art without departing from its spirit and principles, as set forth in the appended claims.

What is claimed is:

1. A display unit for protectively storing and presenting pallet-loaded products for manual removal therefrom, comprising:

a frame assembly including;

a rectangular base frame formed of successively interconnected first, second, third and fourth horizontal rods, said first and third rods defining the front and rear sides of said base frame, and said second and fourth rods defining the right and left sides of said base frame, first, second, third and fourth vertical rods extending upwardly from said base frame, with said first vertical rod connected to and extending upwardly from the juncture of said first and second horizontal rods, said second vertical rod connected to and extending upwardly from the juncture of said second and third horizontal rods, said third vertical rod connected to and extending upwardly from the juncture of said third and fourth horizontal rods, and said fourth vertical rod connected and extending upwardly from the juncture of said first and fourth horizontal rods and, a rectangular top frame connected to the vertically upwards ends of said vertical rods and formed of successively interconnected and horizontally disposed first, second, third and fourth top rods, said top frame overlying and generally corresponding to the shape of said base and spaced therefrom by the extent of said vertical rods, a front wall extending between said first bottom rod, first and fourth vertical rods and first top rod, a right side wall connected to, and extending between, said second bottom rod, first and second vertical rods and second top rod, a rear wall connected to and extending between said third bottom rod, second and third vertical rods and third top rod, a left side wall connected to and extending between said fourth bottom rod, third and fourth vertical rods and fourth top rod, a top wall extending between and connected to said first, second, third and fourth top rods, and said right, rear, left, top and front walls enclosing a generally rectangular internal volume open at its base, and adapted to receive a plurality of units of products to be dispensed from a pallet support;

said front wall including releasable closure means for selectively opening or closing said front wall, with the products to be dispensed being accessible for insertion or manual removal while the front wall is open; and a plurality of anchor plates secured to spaced locations of the horizontal rods forming said base frame and extending inwardly into the internal volume defined by the frame assembly to be positioned below a pallet supporting the products being dispensed, whereby the weight of the pallet-supported products, as transmitted to the anchor plates, retains the display unit in place on a ground support.

2. A display unit according to claim 1 wherein, said releasable closure means include complementary Velcro members along said front wall and the frontal edges of said right and left walls.

3. A display unit according to claim 1, which is formed of knockdown components intended to be assembled at the display unit site, and including rod receiving corner connections at each of the eight junctures of said bottom, vertical and top rods, each of said corner connectors having orthogonally-separated connecting elements adapted to receive and position the three ends of the respective base or top rods, and associated vertical rod.

4. A display unit according to claim 2, further including a releasable connecting means along the exterior surface of said rear wall, for attachment to a complementary releasable connecting means along said front wall, for releasably retaining said front wall in its open condition.

5. A display unit according to claim 4, wherein said releasable connecting means includes Velcro.

6. A display unit according to claim 3, wherein said right, rear and left walls are formed of a first unitary wall unit assembly, and said top and front walls are formed of a second unitary wall unit assembly.

7. A display unit according to claim 6, wherein the upper edges of said right and left walls include a first set of releasable connecting means and said top wall include a complementary second set of releasable connecting means for connecting said first wall unit assembly to said second wall unit assembly.

8. A display unit according to claim 7, wherein said first and second sets of releasable connecting means include Velcro.

9. A display unit according to claim 7, further including a plurality of top wall supporting rods extending between intermediate locations along said first and third top rods.

10. A display unit according to claim 9, each of spaced top wall supporting rods being outwardly arced to convexly support said top wall.

11. A display unit according to claim 1, configured to receive a pallet of soft drink packages.

12. A display unit according to claim 1, wherein said right, rear and left walls are formed of a first unitary wall unit assembly, and said top and front walls are formed of a second unitary wall unit assembly.

13. A display unit according to claim 12, further including a plurality of top wall supporting rods extending between intermediate locations along said first and third top rods, each of spaced top wall supporting rods being outwardly arced to convexly support said top wall.

14. A display unit according to claim 1, wherein at least some of said anchor plates include means for securing same to a ground support.

* * * * *